United States Patent [19]

Matheis

[11] 3,987,828

[45] Oct. 26, 1976

[54] HAMMER

[76] Inventor: John L. Matheis, 8 Delmar Drive, Springfield, Ill. 62703

[22] Filed: May 21, 1975

[21] Appl. No.: 579,563

[52] U.S. Cl. ..... 145/30 A; 7/8

[51] Int. Cl.[2] ..... B25C 1/00; B25D 1/00

[58] Field of Search ..... 145/30 R, 30 A, 29 D, 145/29 R, 50 DA, 46; 254/26; 7/8 R; 227/147; 29/275

[56] References Cited

UNITED STATES PATENTS

| | | | |
|---|---|---|---|
| 82,621 | 9/1868 | Hubbard | 145/30 R |
| 112,902 | 3/1871 | Clarke | 145/29 R |
| 352,070 | 11/1886 | Robertson | 145/30 A |
| 450,011 | 4/1891 | Hackett | 145/30 R |
| 509,399 | 11/1893 | Richardson | 145/30 R |
| 582,294 | 5/1897 | Labagh | 254/26 R |
| 745,973 | 12/1903 | Starrett | 145/30 R |
| 1,041,903 | 10/1912 | Thomas | 145/30 R |
| 1,133,705 | 3/1915 | Caron | 145/30 R |
| 2,597,876 | 5/1952 | Kurkjian | 145/30 A |
| 3,543,821 | 12/1970 | Johnson | 145/30 R |

FOREIGN PATENTS OR APPLICATIONS

| | | | |
|---|---|---|---|
| 1,335,243 | 7/1963 | France | 145/30 A |

*Primary Examiner*—Al Lawrence Smith
*Assistant Examiner*—J. T. Zatarga
*Attorney, Agent, or Firm*—Grace J. Fishel

[57] ABSTRACT

An improved hammer for releasably holding a nail during the initial nail driving operation and providing auxiliary driving means during the nail setting operation including a preliminary driving face with associated magnetic means for releasably holding the nail while the preliminary driving blow is struck and further including a secondary driving face for setting the nail when a flattened heel is struck by a primary driving force.

6 Claims, 6 Drawing Figures

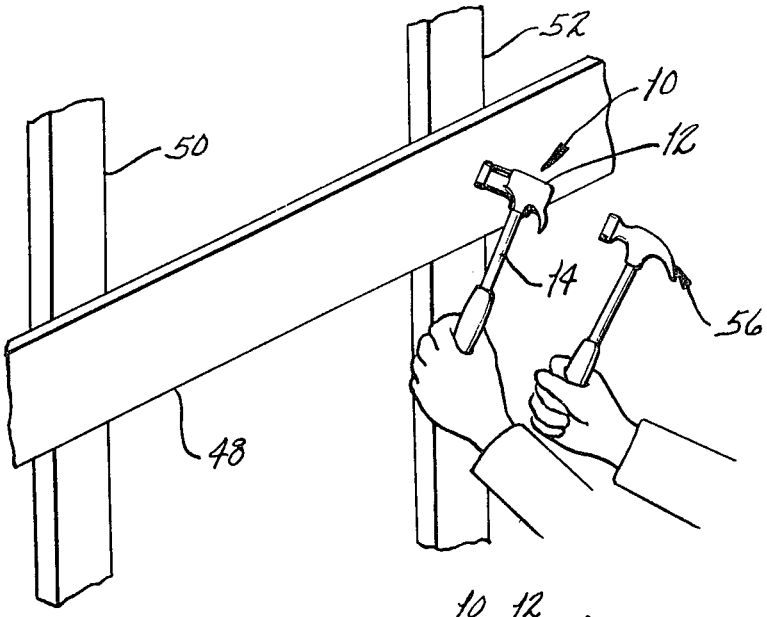
FIG. 1
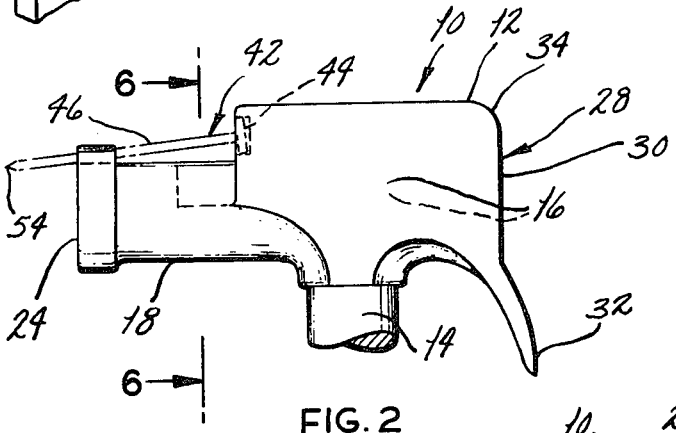
FIG. 2
FIG. 3
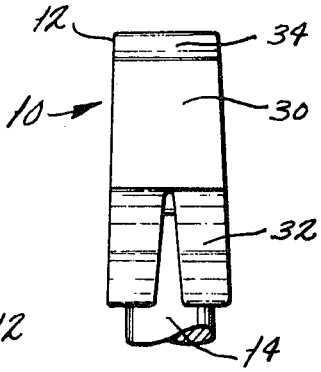
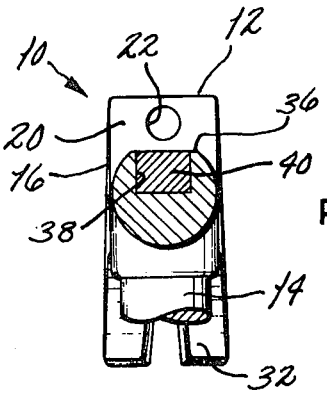
FIG. 6
FIG. 4
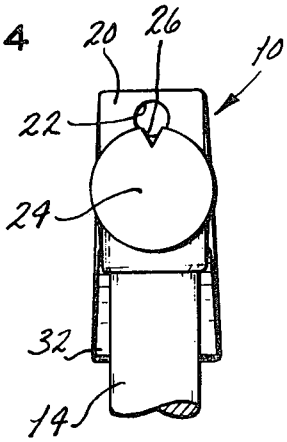
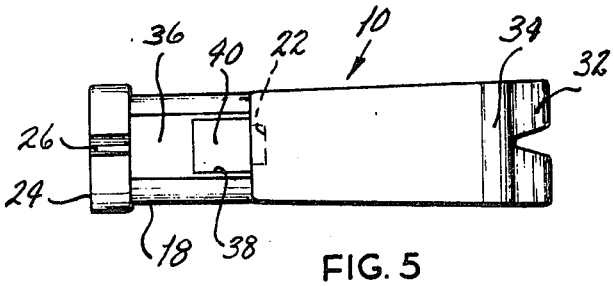
FIG. 5

HAMMER

This invention relates to an improved hammer for holding a nail during preliminary driving and then for serving as auxiliary driving means. More particularly, it relates to a device for releasably holding the nail as it is preliminarily driven into a workpiece without manually grasping the nail shank. It further relates to a device for use in combination with a second hammer for driving the preliminarily set nail in places difficult to reach with an ordinary hammer or for providing a greater driving force.

Various forms of hammers have been proposed to reduce the frustrations encountered in driving nails. Some of these devices have included magnetic means for releasably holding the nail during preliminary driving. However, as any hammer user knows, preliminary setting of the nail is not the only problem. For example, nails sometimes bend over before they can be sunk and some woods, such as walnut, are hard and difficult to penetrate. All of the known prior art hammers which provide preliminary driving means fail to provide auxiliary driving means to minimize some of the other nail driving frustrations such as bent-over nails and difficult to penetrate woods.

Among the several objects of the present invention may be noted the provision of a preliminary nail driving means in combination with an auxiliary nail driving means, said preliminary nail driving means releasably holding a nail during preliminary driving without manually grasping the shank, while said auxiliary nail driving means reduces the effect of off-center blows thereby minimizing bent-over nails and concentrates the driving force of a second hammer, thereby making nail driving easier in hard to penetrate surfaces. Other objects and features will be in part apparent and in part pointed out hereinafter.

The invention accordingly comprises the constructions hereinafter described, the scope of the invention being indicated in the following claims.

In the accompanying drawings in which one of various possible embodiments of the invention is illustrated, FIG. 1 is a perspective view of the improved hammer of the present invention after having preliminarily set a nail driving the nail in response to blows struck by a second hammer;

FIG. 2 is an enlarged side elevational view of the improved hammer with a portion of the handle broken away; shown in broken lines is a nail ready to be preliminarily driven;

FIG. 3 is a right hand end view of the hammer head shown in FIG. 2;

FIG. 4 is a left hand end view of the hammer head shown in FIG. 2;

FIG. 5 is a top view of the hammer head shown in FIG. 2; and

FIG. 6 is a sectional view taken along line 6—6 in FIG. 2.

Corresponding reference characters indicate corresponding parts throughout the several views of the drawings.

As best seen in FIG. 2, reference numeral 10 refers to an improved hammer which includes a hammer head 12 attached to a handle 14.

Hammer head 12 has a pair of flat, substantially parallel, side cheeks 16 and a muzzle 18. A preliminary nail driving face 20 is formed as an abutment shoulder adjacent one end of muzzle 18 and substantially perpendicular to the long axis thereof. A recess 22 is positioned symmetrically in preliminary nail driving face 20 and is sized to receive a nail head as described below.

At the other end of muzzle 18 is secondary nail driving face 24 which is generally round in cross-section and positioned below but substantially parallel to preliminary nail driving face 20. A notch 26 is provided in the periphery of secondary nail driving face 24 in alignment with recess 22 and adapted to receive shank 46 of a nail 42 when nail head 44 is held in recess 22.

Hammer head 12 further has a heel 28 with a flattened anvil face 30 and a swallow tail claw 32. As shown, anvil face 30 is positioned behind and substantially parallel to preliminary nail driving face 20 and secondary nail driving face 24. At its upper end, anvil face 30 includes rounded portion 34 adapted to spread compressive forces so as to minimize denting in surfaces when claw 32 is used to pull a nail.

Muzzle 18 has flattened portion 36 wherein a recess 38 is provided to receive a magnet 40, preferably of the permanent type. As shown, magnet 40 is received in recess 38 which is aligned with recess 22 and notch 26 and located adjacent preliminary nail driving face 20.

In use, nail 42 is placed laterally on hammer head 12 with nail head 44 received in recess 22 and nail shank 46 supported in notch 26. Nail 42 is held in place on hammer head 12 by magnet 40 so that the nail moves with the hammer head.

As shown in FIG. 1, rail 48 is to be attached to posts 50 and 52. With nail 42 on hammer head 12, hammer 10 is swung sufficiently hard so that when nail point 54 strikes the workpiece, the point is driven sufficiently far into the wood that the nail stays in place after the preliminary blow and preferably rail 48 is temporarily secured to one of posts 50,52.

By tipping hammer 10, nail 42 is separated from magnet 40. To facilitate this separation, recess 22 is located in a plane above notch 26 and magnet 40 so that nail shank 46 does not come into touching contact with the magnet.

A second nail 42 is then preliminarily driven at the opposite end of rail 48 as shown in FIG. 1 so that the rail is temporarily secured to posts 50, 52, ready for the nails to be finally driven.

After nails 42 have been temporarily driven into rail 48 and posts 50,52, they are usually driven in an ordinary manner by blows from secondary nail driving face 24. In difficult to reach places, nails 42 are driven, as shown in FIG. 1, by blows from secondary nail driving face 24 in response to blows struck by second hammer 56 on flattened anvil face 30 of hammer 10. Thus, nail 42 is driven straight without bending over even in difficult to reach places as long as secondary nail driving face 24 is maintained substantially parallel to nail head 44 even though second hammer 56 may strike anvil face 30 off-center blows. In difficult to penetrate workpieces such as walnut, second hammer 56 is also used to advantage and may be selected heavier than would otherwise be suitable to act as a sledge.

Second hammer 56 is similarly used when nails 42 are preliminarily set in difficult to reach places or hard to penetrate surfaces since flattened anvil face 30 of hammer 10 is so positioned that nail 42 is driven by preliminary nail driving face 20 in response to a blow on the anvil face.

The improved hammer of the present invention is useful with nails of any size which are long enough that nail point 54 extends beyond secondary nail driving face 24 when nail head 44 is received in recess 22. Other hammers according to this invention may be adapted for use with other sized nails.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a hammer head having an ordinary nail driving face formed adjacent one end of a muzzle and a claw at the other end thereof, the improvement comprising a preliminary nail driving face between the ordinary nail driving face and the claw, a recess in the preliminary nail driving face, said recess adapted to freely receive a nail head a flattened anvil face adjacent the claw and a magnet in the muzzle adjacent but below said recess such that the shank of a nail held by said hammer head will not be in substantial contact with said magnet wherein the ordinary nail driving face and the flattened anvil face are substantially parallel, wherein the flattened anvil face is located directly behind the ordinary nail driving face and the preliminary nail driving face, and wherein the flattened anvil face is adapted to be struck by a second hammer.

2. A hammer head according to claim 1 wherein said ordinary nail driving face is circular in cross-section and has a notch in its periphery adapted to receive a nail shank.

3. A hammer head according to claim 2 wherein said magnet is a permanent magnet.

4. A hammer head according to claim 3 having flattened side cheeks.

5. A hammer head according to claim 4 wherein said flattened anvil face terminates in a rounded portion opposite the claw adapted to spread compressive forces when the claw is used to pull a nail, said rounded portion extending to the flat side cheeks.

6. A hammer head according to claim 5 which is adapted to be attached to a handle.

* * * * *